United States Patent [19]

Davies et al.

[11] 4,397,137

[45] Aug. 9, 1983

[54] PNEUMATIC YARN SPLICING

[75] Inventors: Gerald B. Davies, Pontypool; Roger J. Shea, Monmouth, both of Wales

[73] Assignee: Pentwyn Precision, Ltd., United Kingdom

[21] Appl. No.: 271,994

[22] Filed: Jun. 9, 1981

[30] Foreign Application Priority Data

Jun. 10, 1980 [GB] United Kingdom ..... 8018947
Jun. 2, 1981 [EP] European Pat. Off. ..... 81302446.0

[51] Int. Cl.[3] ..... D01H 15/00
[52] U.S. Cl. ..... 57/22
[58] Field of Search ..... 57/22, 23, 261, 262, 57/263

[56] References Cited

U.S. PATENT DOCUMENTS 3,306,020 2/1967 Rosenstein ..... 57/22 X
3,581,486 1/1971 Dibble ..... 57/22
4,232,509 11/1980 Rohner et al. ..... 57/22 X

*Primary Examiner*—Donald Watkins
*Attorney, Agent, or Firm*—Allegretti, Newitt, Witcoff & McAndrews, Ltd.

[57] ABSTRACT

Yarn splicing chambers which in one form comprise a block with an open channel therethrough, one wall of the channel being vertical and the other inclined to form an included angle of between 30° to 45°. An inlet is provided centrally of the bottom of the channel for admission thereto of gas under pressure of 5.5 bars to produce vortex flow having a predominant direction of rotation when, in use, the open top of the channel is sealed by a shutter, the gas exhausting out of the open ends of the channel into which yarns are introduced for splicing. An alternative form of chamber comprises a block having an open channel therethrough wherein each wall of the channel comprises a first wall portion substantially vertical with respect to a flat bottom portion of the channel at respective end portions of the channel, and a second wall portion inclined with respect to the said flat bottom portion, and the inlet means is located within the central portion of the channel.

Other forms of chamber include blocks having V-channels with two small holes in the base of the channel tangential to a blind bore in the block forming the inlet for high pressure gas.

13 Claims, 14 Drawing Figures

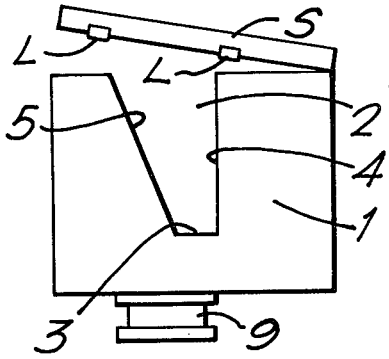
FIG.1.
FIG.2.
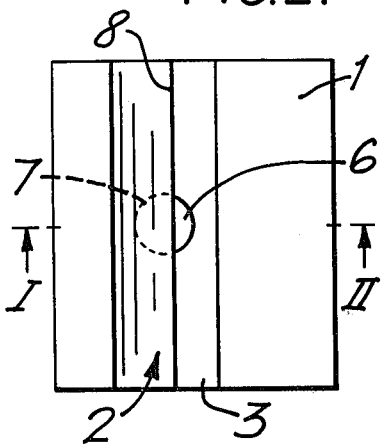
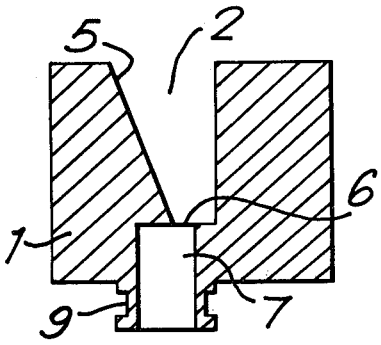
FIG.3.
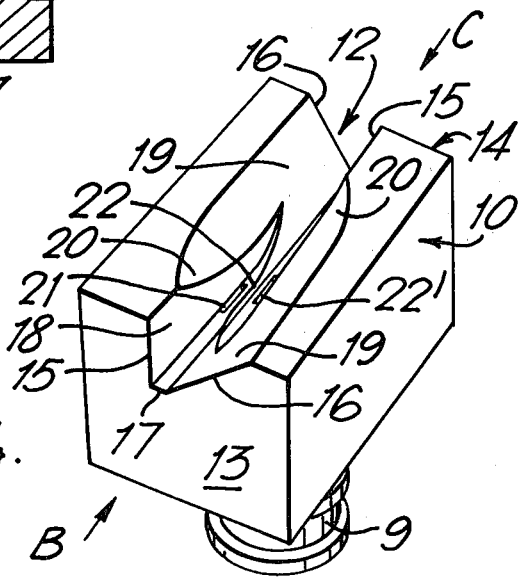
FIG.4.

FIG.5.
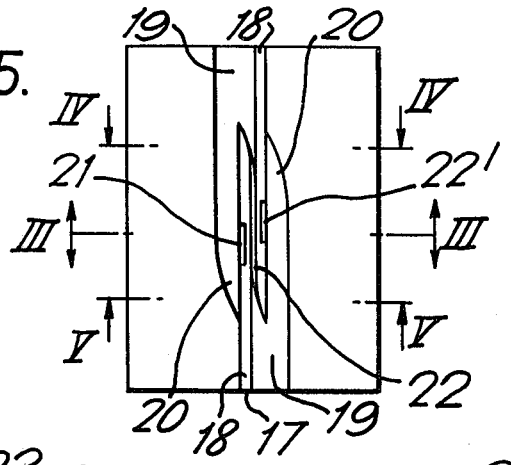
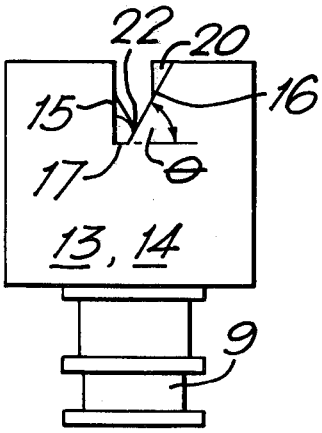
FIG.6.
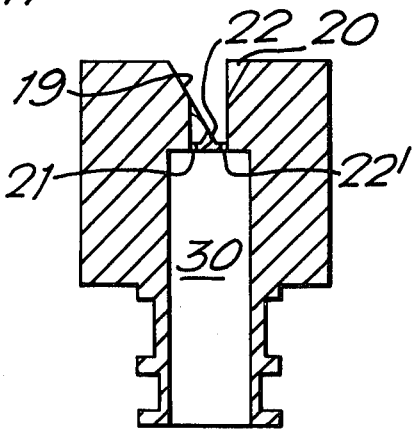
FIG.7.
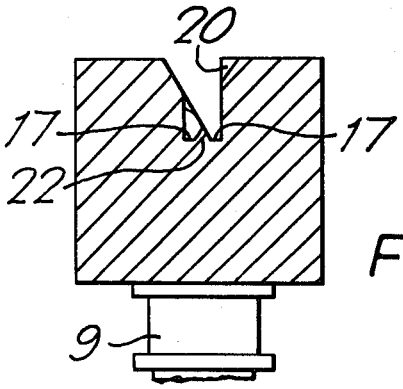
FIG.8.

PNEUMATIC YARN SPLICING

FIELD OF THE INVENTION

This invention relates to pneumatic yarn splicing and in particular to splicing chambers for use in pneumatic yarn splicing and apparatus comprising such splicing chambers.

PRIOR ART

In pneumatic yarn splicing apparatus it is known to use splicing chambers comprising a block with a channel of V-shaped cross-section which cross-section is uniform throughout the length of the channel. An opening is provided for admission of high pressure gas e.g. air, to the bottom and mid-way along the channel. In operation the respective ends of two yarns are located in the channel, the top of which is sealed, and high pressure gas forced through the chamber via the opening. The flow of gas through the chamber is turbulent and generally causes the fibres of the yarns therein to loosen and mingle with each other thereby to effect a splice.

It has been found, however, that as the twist factor of yarn increases the quality of the splices achieved with conventional apparatus is reduced because, it is believed, of the increasing reluctance of the high twist yarns to become disentangled in the air blast. This is a particular problem in respect of yarn of multi-ply and single yarns of high twist construction with high twist in the plies and the final high twist level when the yarn is assembled.

SUMMARY OF THE INVENTION

Broadly speaking the present invention provides a splicing chamber for use is pneumatic yarn splicing apparatus, comprising a block with a through channel for receiving the ends of the yarns to be spliced and inlet means for the admission of gas under pressure to the channel, the arrangement being such that, in use of the chamber with the open top of the channel sealed along at least part of its length, vortex flow having a predominant direction of rotation is created in gas admitted through the inlet means as it passes towards the open ends of the channel to exhaust therethrough.

In one proposed embodiment of our invention the channel comprises a substantially flat bottom, a first wall substantially vertical with respect to the bottom, a second wall inclined with respect to the bottom, and the inlet means comprises an opening in the bottom immediately adjacent the junction of the bottom and the inclined wall. The opening may be approximately mid length of the channel and the vertical wall and inclined wall both extend the full length of the channel. Usually the two walls of the channel in this embodiment will subtend an internal angle of from approximately 30° to approximately 75°.

In a preferred embodiment the channel is of asymmetrical configuration. In an embodiment described below each wall of the channel comprises a first wall portion substantially vertical with respect to a flat bottom portion of the channel at respective end portions of the channel, and a second wall portion inclined with respect to the said flat bottom portion, and the inlet means is located within the central portion of the channel. Usually the second wall portion is inclined at an angle of approximately 30° to approximately 75° to the vertical.

In an embodiment described below the respective inclined wall portions define an intermediate channel portion of wider cross-section than the end portions of the channel, the respective flat bottom portions being offset and overlapping lengthwise of the channel and being separated by a central ridge extending along substantially the longitudinal axis of the channel, and the inlet means comprises one or more openings in each flat bottom portion or either side of said central ridge. It is preferred that the openings be elongate and that they overlap in the longitudinal direction of the channel although an overlap is not essential in this configuration.

The blocks described below can be fabricated by machining of a solid metal block e.g. of steel, but may be made by moulding of e.g. plastics material.

A splicing chamber in accordance with a present invention may be used in conventional pneumatic yarn splicing apparatus in which it is substituted for a conventional splicing chamber as briefly described above.

In operation the ends of the yarn to be spliced are laid into the open ended channel, a shutter is moved to a closed position forming an air seal along at least part of the top of the channel, and a blast of compressed air admitted to the channel through the openings which exhausts through the open ends of the channel.

The channel and inlet means may be so configured and dimensioned that the predominant direction of rotation of vortex flow through the channel, from the inlet means to the respective open ends, in contrary to the direction of twist (i.e. 'S' or 'Z' twist) of the yarn, especially the direction of the assembly twist in the case of multi-ply yarn.

BRIEF DESCRIPTION OF THE DRAWINGS

In order that the invention may be more fully understood embodiments in accordance therewith will now be described with reference to the following drawings in which:

FIG. 1 is an end view of an embodiment of a splicing chamber in accordance with the present invention;

FIG. 2 is a view from above the splicing chamber shown in FIG. 1;

FIG. 3 is a section through FIG. 2 along line I–II;

FIG. 4 is a perspective view of another embodiment of a splicing chamber in accordance with the present invention;

FIG. 5 is a view from above of the splicing chamber of FIG. 4;

FIG. 6 is a view in the direction of either arrow B or arrow C of FIG. 4;

FIG. 7 is a section through the splicing chamber of FIG. 5 at III—III viewed in either direction;

FIG. 8 is a section through the splicing chamber of FIG. 5 at either IV—IV or V—V;

DETAILED DESCRIPTION OF PREFERRED EMBODIMENTS

Figure 9:
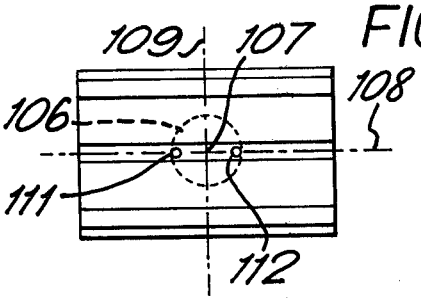
FIGS. 9, 10 and 11 are plan, cross-sectional side and end views respectively of a V-block in accordance with this invention.

Referring to FIGS. 1 to 3 this shows a splicing chamber for use in pneumatic splicing apparatus. The chamber comprises a block 1 having a longitudinally extending through channel 2. The channel 2 is defined by a flat bottom 3, a vertical wall 4 and a wall 5 inclined from the vertical. Along the centre portion of the channel an opening 6 is formed in the channel bottom 3 for the inlet of gas e.g. air, under pressure. The opening 6 is constituted by the end of a circular section hole 7 formed in the block and extending just as far as the flat bottom 3 but sufficiently offset therefrom that the bottom edge 8 of the inclined wall 5 extends across the end thereof as a chord, thereby allowing only partial introduction of the end of hole 7 to the bottom 3. It will be seen, therefore that opening 6 is immediately adjacent the bottom edges of inclined wall 5 and extends only part way across the bottom 3 although it may extend to the junction of the bottom 3 and the vertical wall 4.

A connector piece 9 is attached to the bottom of the block 1 for connection of the chamber to a source of gas under pressure.

In operation the splicing chamber is used in a different manner from that of conventional splicing chambers. That is, the ends of the yarn to be spliced are laid in from the same side of the channel, one side for a Z twist and the other side for an S twist the open top of the channel is sealed, by a shutter S having resilient lips L and a jet of compressed gas, usually air, is fed as a jet into the channel via hole 7 and opening 6. Since both yarns are laid in the same side of the channel, the splice produced forms a spike substantially at right angles to the yarns. The spike may be subsequently trimmed if desired. Unlike the gas flow in conventional V-shaped channels in which the gas flows in vortices with substantially equal and opposite directions of rotation on either side of the axial plane of the channel in the embodiment described herein vortex flow having a predominant direction of rotation is created in the gas passing from the inlet to the open ends of the channel.

Referring to the FIGS. 4 to 8, these show a splicing chamber formed from a solid block 10 of metal of generally cuboid configuration. A channel 12 extends through the block from one end face 13 to the opposite end face 14. The channel is generally straight but is of non-uniform cross-section throughout its length as will be described below, and is, in operation sealed by a shutter similar to the shutter 5 shown in FIG. 1.

Referring to FIG. 6 this shows that at the ends which open out onto the respective end faces 13, 14 the channel has a cross-section defined by a vertical edge 15 and an inclined edge 16 connected by a horizontal edge 17 constituting a flat bottom to the channel 12 at that particular channel and (both ends of the channel, in this embodiment being, to all intents and purposes mirror images of each other).

The walls of the channel are each formed by a vertical wall portion 18 (defining with the respective end face vertical edge 15) and an inclined wall portion 19 (defining with the respective end face inclined edge 16).

The vertical wall portion 18 extends at its full height (as shown in FIG. 6) for a fraction of the length of the channel 12 whereat it meets the inclined wall portion 19. The inclined wall portion 19 initially cuts the vertical wall portion 18 and upper face of the block with a tapered, arcuate chamfered part 20 and thereafter, from about mid way of the length of the channel extends with edges parallel to the general longitudinal direction of the channel.

The flat bottoms 17 of the channel 12 extend from the respective end faces 13, 14 each to a position directly facing the point at which the inclined wall portion 19 of the facing wall of the channel terminates. It will be seen that the respective flat bottoms 17 are not axially aligned but are offset and substantially parallel to each other.

The flat bottoms 17 extend or cut through the respective inclined wall portion 19 so as to form, together, a central ridge 22 therebetween, the faces of which correspond to the lowermost edges of the inclined wall portions.

Inlet means to the channel is provided in the form of one or more slots, e.g. two slots 21, 22' each arranged on either side of the central ridge 22 so as to open into the channel via one and the other of the said flat bottoms 17. The slots are elongate and may overlap in the general longitudinal direction of the channel. The mid point of each slot is approximately at the same position longitudinally of the channel as where the arcuately chamfered portion of the inclined wall portion 19 becomes parallel to the general longitudinal axis of the channel. The slots 21, 22 are formed by the coincidence of the flat bottom portion of the channel 22 with circular section hole 30 which extends through the block 10 from the bottom face thereof.

Gas is supplied to the channel through the slots via a connector piece 9 integrally connected to the bottom face of the block 1 and hole 30.

It will be seen that the two walls of the channel are mirror images of each other so that the channel is of asymmetric configuration. This compares with the channel configuration acknowledged above which is symmetric about a central vertical plane.

A splicing chamber as described with reference to FIGS. 4 to 8 which has been found to give useful results has a maximum channel depth of 4.0 mm, vertical walls offset laterally by a distance of 1.0 mm, and flat bottom portions having a width of 0.37 mm. The overall length of the channel is 19 mm. Usually the angle $\theta$ of the inclined wall to the plane in which the flat bottom portions lie is 60° though this may vary between 30° and 75°. These angles will also apply to the inclined wall in the first embodiment.

If desired the vertical wall portion 18 of the second embodiment described above may be slightly inclined, say up to 5° to the vertical, or possibly may not be flat, as shown, but slightly bowed, or have other configurations which do not have an undesirable affect on the gas flow pattern through the channel.

As in the case of the first embodiment described above the splicing chamber of FIGS. 4 to 8 may be used in conventional pneumatic splicing apparatus. The usual manner of operation will be to lay the ends of the yarn to be spliced into the chamber from opposite directions, air tightly seal the top of the channel with a shutter such as shutter 5 in FIG. 1, and blast a jet or gas into the channel through the openings 21, 22'. The configuration and dimensions of the channel walls and openings are chosen such that the vortex gas flow from the openings to the respective open ends of the channel will have, in the embodiment described, a predominant direction of rotation, rather than, in the case of a conventional V-shaped channel a number of vortices with equal and opposite directions of rotation. By virtue of the arrangement described above we have found it possible to achieve better splices in high twist yarns than with existing splicing chambers. Usually the splicing chamber will be configured and dimensioned so as to achieve a predominant direction of vortex rotation which is contrary to the direction of twist of the yarn in the case of multiplie yarns contrary to the direction of the assembled yarn. For instance in the embodiment shown in FIGS. 4 to 8 the direction of vortex rotation can be reversed by making a mirror image of the chamber.

Figure 10:
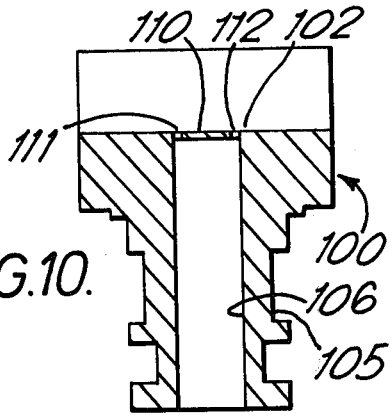
Figure 11:
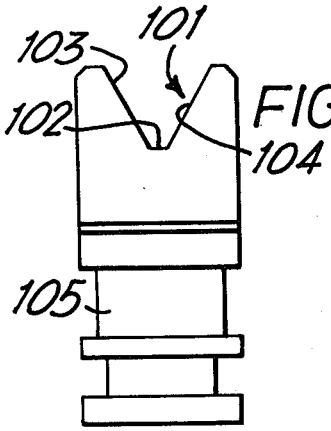

A further embodiment of a yarn splicing chamber shown in FIGS. 9, 10 and 11 is particularly suitable for short staple yarns such as finer 100% cotton yarn singles 80 English cotton count; also 2 fold wool and wool synthetic blends worsted count 2/40; and continuous filament industrial yarns. This chamber is a modified form of the conventional V-block and comprises a block 100 having machined therein a V groove 101 with a flat bottom 102, the side walls 103, 104 making an angle of between 45° and 75°. The bottom of the block 100 is machined to form an air inlet nozzle 105 having a 4 mm bore 106 whose axis lies on the intersection 107 of the longitudinal 108 and transverse 109 axes of the block 100 and which terminates just below the flat bottom 102 leaving a thickness of material 110 of about between 0.1 and 0.15 mm. Two 1 mm holes 111, 112 are accurately drilled through the bottom 102 one each side of the intersection 107 on the longitudinal axis 108 so that they are tangential to the bore 108 as shown in FIGS. 9 and 10. The open top of the V-groove is sealed by a shutter, such as shutter S in FIG. 1, air under pressure of about 5.5 bars is admitted through the nozzle 105 into bore 106 where it exits through the holes 111 and 112 respectively. As a result of the high energy produced in the vortices and the predominant direction of rotation thereof, yarns introduced one each side of the blocks and situated in the bottom 102 are unravelled and then intermingled to produce a strong splice. Air consumption in this embodiment is about 65–75 liters per minute. Preferably the block is 15–19 mm long, 9.5 mm wide with the depth of the V-groove between 3.0 to 5.5 mm.

Figure 12:
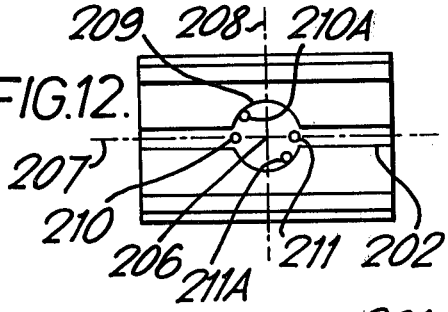
FIGS. 12, 13 and 14 are plan, cross-sectional side and end views respectively of a modified form of the V-block shown in FIGS. 9, 10 and 11.
Figure 13:
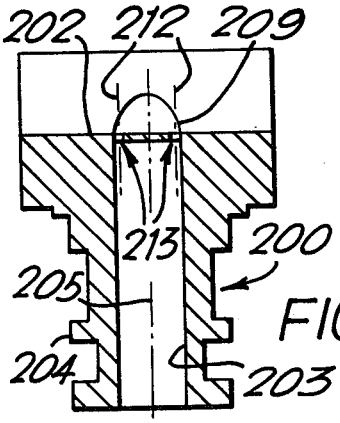
Figure 14:
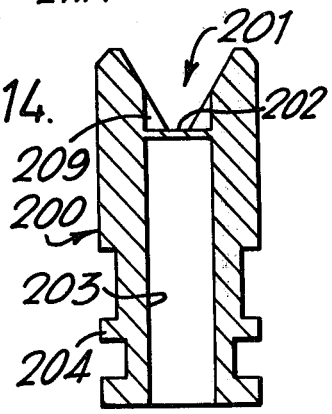

A modification of the yarn splicing chamber shown in FIGS. 9, 10 and 11 and having substantially similar dimensions is illustrated in FIGS. 12, 13 and 14. This embodiment is particularly suitable for yarns of English cotton count 40 and comprises a block 200 having a V-groove 201 machine therein with a flat bottom 202. A 4 mm bore 203 is drilled in the base 204 of the block to form a circular passageway whose axis 205 intersects the intersection 206 of the longitudinal and transverse axes 207 and 208 respectively of the block 200. A flat bottomed cavity 209 is formed by drilling centrally in the block a 4 mm hole whose axis is coincident with the axis 205 and which is of a diameter substantially the same as that of the bore 203. Two further 1 mm holes 210 and 211 are drilled in the bottom 202 symmetrically each side of the intersection 206 and tangentially to the bore 203 or alternatively two or four 1 mm holes 210A and 211A are drilled in the flat bottom of the cavity 209 symmetrically each side of the intersection 206 and tangentially to the bore 203 on an axis which lies between the longitudinal and transverse axes 207 and 208 as shown in FIG. 12.

The bore 203 terminates just below the flat bottom 202 to leave a thickness of material of between 0.1 to 0.15 mm.

The operation of the block shown in FIGS. 12, 13 and 14 is similar to that of the block shown in FIGS. 9, 10 and 11, a shutter such as shutter S in FIG. 1 sealing the top of the V-groove to allow air under pressure of about 5.5 bars to exit from the holes 210, 211 or 210A and 211A and flow out through the ends of the V-groove where the ends of yarns to be spliced are admitted. That portion of the holes 210, 211 tangential to the bore 203 produce a region 212 of laminar flow whilst vortices having opposite directions of rotation are produced mainly by the sharp edges 213 of the holes opposite the wall of the bore 203.

Again the high energy produced by the disposition of holes in the cavity 209 result in the vortices, which have predominant directions of rotation, unravelling the yarns and then intermingling them to produce a strong splice. The air consumption is again approximately 60 to 75 lites/minute.

In all the embodiments described above instead of compressed air, compressed fluid in a vapour phase may be used, e.g. compressed air with a surfactant, particularly where yarns need to be degreased before splicing. Also the dimensions given are by way of example only and are not limited to the exact values given. In the blocks shown in FIGS. 9 to 15; for example, the diameter of the holes 111, 112 and 210, 211, and that of the bores 106, 203 may be larger or smaller than 1 mm, or 4 mm respectively. Preferably the ratio in diameters of the holes 111, 112; 210, 211 and bores 106; 203 is 8:1.

All the embodiments described above are designed to make better use of the energy produced by the turbulent air stream than the already known forms of block referred to in the opening paragraphs of this specification. The blocks according to this invention utilise more of the energy produced by the high speed vortices to unravel high twist yarns and then intermingle them to produce a strong splice.

The blocks enable high twist yarn to be spliced without increasing the input gas pressure, normally about 5.5 bars to dangerously high levels which would be necessary in some V-blocks of conventional construction.

The block may be used in hand held splicers or automatic splicers mounted on yarn winding machines, in both cases means are provided for holding each yarn introduced into a block whilst the splice is formed and cutters may be provided to trim the free ends on each yarn either before, after or during the formation of the splice.

We claim:

1. A yarn splicing chamber for use in pneumatic yarn splicing apparatus, comprising a block for receiving the ends of the yarns to be spliced having a longitudinal channel of asymmetrical configuration about its axis and being open at its top, inlet means for the admission of gas under pressure to the channel, and means for sealing said channel at the top thereof to form outlets at opposed ends of said channel, whereby a vortex flow having a predominant direction of rotation is created in gas admitted through the inlet means as it passes towards said outlets to be exhausted therefrom.

2. A yarn splicing chamber according to claim 1, in which in the vicinity of said inlet means the channel comprises a substantially flat bottom, a first wall substantially vertical with respect to the bottom, a second wall inclined with respect to the bottom, and the inlet means comprises an opening in the bottom immediately adjacent the junction of the bottom and the inclined wall.

3. A yarn splicing chamber according to claim 2, wherein the opening is mid length of the channel and the vertical wall and inclined wall both extend the full length of the channel.

4. A yarn splicing chamber according to claim 2 or 3, wherein the two walls subtend an internal angle of between 30° and 75°.

5. A splicing chamber according to claim 1, wherein each wall of the channel comprises a first wall portion substantially vertical with respect to a flat bottom portion of the channel at respective end portions of the channel, and a second wall portion inclined with respect to the said flat bottom portion, and the inlet means located substantially mid-length of the channel.

6. A splicing chamber according to claim 5, wherein the second wall portion is inclined at an angle between 30° and 75° to the vertical.

7. A splicing chamber according to claim 5, wherein the respective inclined wall portions define an intermediate channel portion of wider cross-section than end portions of the channel, the respective flat bottom portions being offset and overlapping lengthwise of the channel and being separated by a central ridge, and the inlet means comprises at least one opening in the flat bottom portion on either side of said central ridge.

8. A splicing chamber according to claim 5, wherein two openings are provided, the openings being elongate and overlapping in the longitudinal direction of the channel.

9. A yarn splicing chamber for use in pneumatic yarn splicing apparatus, comprising a block defining a channel therethrough for receiving the ends of yarns to be spliced, and inlet means for admission of gas under pressure to a central portion of said channel, the channel comprising a flat bottom portion, a first wall at between 0° and 5° to the vertical with respect to the flat bottom portion and a second wall inclined between 30° and 75° to said flat bottom portion, and said inlet means including at least one opening into said flat bottom portion to create vortex flow having a predominant direction of rotation as, in use, gas under pressure is admitted to said chamber through said opening with the open top of said channel sealed by a shutter.

10. A yarn splicing chamber for use in pneumatic yarn splicing apparatus, comprising a block defining a V-shaped channel therethrough to receive the ends of yarns to be spliced, said channel having a substantially flat bottom at least along the central portion thereof, inlet means for admission of gas under pressure to said channel, a shutter for closing the open top of said channel, and at least two holes in said flat bottom, said inlet means including a blind bore and said holes being tangential to said bore so that in use of the chamber with the shutter sealing the top of said channel vortices having a predominant direction of rotation are produced by gas issuing from said two holes into said channel.

11. A chamber according to claim 10 in which said at least two holes lie on the longitudinal axis of said channel.

12. A chamber according to claim 10, wherein said channel defines a circular recess having a diameter substantially the same to said blind bore with the axis of said recess coincident with that of said bore.

13. A chamber according to claim 12, wherein said at least two holes are located within said recess on a diameter thereof at a predetermined angle to the longitudinal axis of said channel.

* * * * *